US006065891A

United States Patent [19]

Rehman et al.

[11] Patent Number: 6,065,891

[45] Date of Patent: May 23, 2000

[54] SQUEEZABLE LIQUID DISPENSING BRUSH

[76] Inventors: Amer B. Rehman; Nouha Rehman, both of P.O. Box 630092, Houston, Tex. 77263

[21] Appl. No.: 09/209,612

[22] Filed: Dec. 11, 1998

[51] Int. Cl.[7] ..... B43M 11/06

[52] U.S. Cl. ..... 401/183; 401/184; 132/112; 132/116

[58] Field of Search ..... 401/183, 184; 132/112, 113, 114, 115, 116

[56] References Cited

U.S. PATENT DOCUMENTS

| | | | |
|---|---|---|---|
| 953,267 | 3/1910 | Heffner et al. | 132/112 |
| 1,190,017 | 7/1916 | Scheel | 132/114 |
| 2,278,811 | 4/1942 | Wallenius | 132/112 X |
| 2,897,826 | 8/1959 | Di Vito | 401/183 X |
| 3,147,757 | 9/1964 | Hofmann | 132/114 |
| 4,176,980 | 12/1979 | O'Neal et al. | 401/184 X |
| 4,221,492 | 9/1980 | Boscardin et al. | 401/184 |
| 5,443,321 | 8/1995 | Dolan et al. | 132/112 X |

*Primary Examiner*—David J. Walczak

[57] ABSTRACT

A squeezable liquid dispensing brush is provided including an inboard extent and an outboard extent. The outboard extent is coupled to the inboard extent with a plurality of bores formed therein. Also included is a plurality of bristles each having an inboard end mounted on a lower surface of the outboard extent and extending therefrom for combing a coloring solution into hair of a user.

5 Claims, 2 Drawing Sheets

SQUEEZABLE LIQUID DISPENSING BRUSH

BACKGROUND OF THE INVENTION

1. Field of the Invention

The present invention relates to liquid dispensing brushes and more particularly pertains to a new squeezable liquid dispensing brush for dispensing a color solution within hair of a user.

2. Description of the Prior Art

The use of liquid dispensing brushes is known in the prior art. More specifically, liquid dispensing brushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art liquid dispensing brushes include U.S. Pat. No. 5,339,839; U.S. Pat. No. 4,605,026; U.S. Pat. No. 5,024,243; U.S. Pat. No. 1,051,714; U.S. Pat. No. 3,137,305; and Foreign Patents WO 86/01073 and WO 89/09002.

In these respects, the squeezable liquid dispensing brush according to the present invention substantially departs from the conventional concepts and designs of the prior art, and in so doing provides an apparatus primarily developed for the purpose of dispensing a color solution within hair of a user.

SUMMARY OF THE INVENTION

In view of the foregoing disadvantages inherent in the known types of liquid dispensing brushes now present in the prior art, the present invention provides a new squeezable liquid dispensing brush construction wherein the same can be utilized for dispensing a color solution within hair of a user.

The general purpose of the present invention, which will be described subsequently in greater detail, is to provide a new squeezable liquid dispensing brush apparatus and method which has many of the advantages of the liquid dispensing brushes mentioned heretofore and many novel features that result in a new squeezable liquid dispensing brush which is not anticipated, rendered obvious, suggested, or even implied by any of the prior art liquid dispensing brushes, either alone or in any combination thereof.

To attain this, the present invention generally comprises an inboard extent having a hollow generally cylindrical configuration. As shown in the Figures, the inboard extent is preferably equipped with a first length and a first diameter along the entire length thereof. The inboard extent has an open rear with a threaded interior surface for releasably coupling with a cap. Such cap has a radially extending gripping flange mounted thereon with a plurality of spaced gripping undulations. A threaded sleeve of the cap is adapted for coupling with the threaded interior surface of the inboard extent. By this structure, a coloring solution may be situated within the inboard extent. Next provided is an intermediate extent having a hollow generally cylindrical configuration. As shown in FIG. 4, the intermediate extent has the first length and a second diameter less than the first diameter. Further, the intermediate extent includes a rear end integrally coupled to a front end of the inboard extent. The intermediate extent preferably extends from the inboard extent along an axis which resides at an angle of about 30 degrees with respect to that of the inboard extent. Also included is an outboard extent having a hollow kidney-shaped cross-section and the first length. The outboard extent has a closed front end and a rear end integrally coupled to a front end of the intermediate extent. By such coupling, the outboard extent resides along an axis in parallel relationship with that of the inboard extent. As shown in FIG. 2, the outboard extent has a lower surface with a plurality of bores formed therein in communication with an interior space of the inboard extent, intermediate extent, and outboard extent. For reasons that will soon become apparent, a size of the bores is directly proportional to a distance from the intermediate extent. With reference again to FIG. 4, it is shown that the inboard extent and intermediate extent have a lower surface with a thickened rigid portion formed in the interior space thereof. Such rigid portion is adapted for maintaining the relative relationship of the inboard and intermediate extents. This is accomplished while allowing the secretion of the coloring solution from the bores of the outboard extent by the depression of an upper surface of the inboard extent. Finally, a plurality of linear, resilient and solid bristles are provided each having an inboard end mounted on the lower surface of the outboard extent. The bristles extend radially from the outboard extent for combing the coloring solution into hair of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new squeezable liquid dispensing brush apparatus and method which has many of the advantages of the liquid dispensing brushes mentioned heretofore and many novel features that result in a new squeezable liquid dispensing brush which is not anticipated, rendered obvious, suggested, or even implied by any of the prior art liquid dispensing brushes, either alone or in any combination thereof.

It is another object of the present invention to provide a new squeezable liquid dispensing brush which may be easily and efficiently manufactured and marketed.

It is a further object of the present invention to provide a new squeezable liquid dispensing brush which is of a durable and reliable construction.

An even further object of the present invention is to provide a new squeezable liquid dispensing brush which is susceptible of a low cost of manufacture with regard to both materials and labor, and which accordingly is then susceptible of low prices of sale to the consuming public, thereby making such squeezable liquid dispensing brush economically available to the buying public.

Still yet another object of the present invention is to provide a new squeezable liquid dispensing brush which provides in the apparatuses and methods of the prior art some of the advantages thereof, while simultaneously overcoming some of the disadvantages normally associated therewith.

Still another object of the present invention is to provide a new squeezable liquid dispensing brush for evenly dispensing a color solution within hair of a user.

Even still another object of the present invention is to provide a new squeezable liquid dispensing brush that includes an inboard extent and an outboard extent. The outboard extent is coupled to the inboard extent with a plurality of bores formed therein. Also included is a plurality of bristles each having an inboard end mounted on a lower surface of the outboard extent and extending therefrom for combing a coloring solution into hair of a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
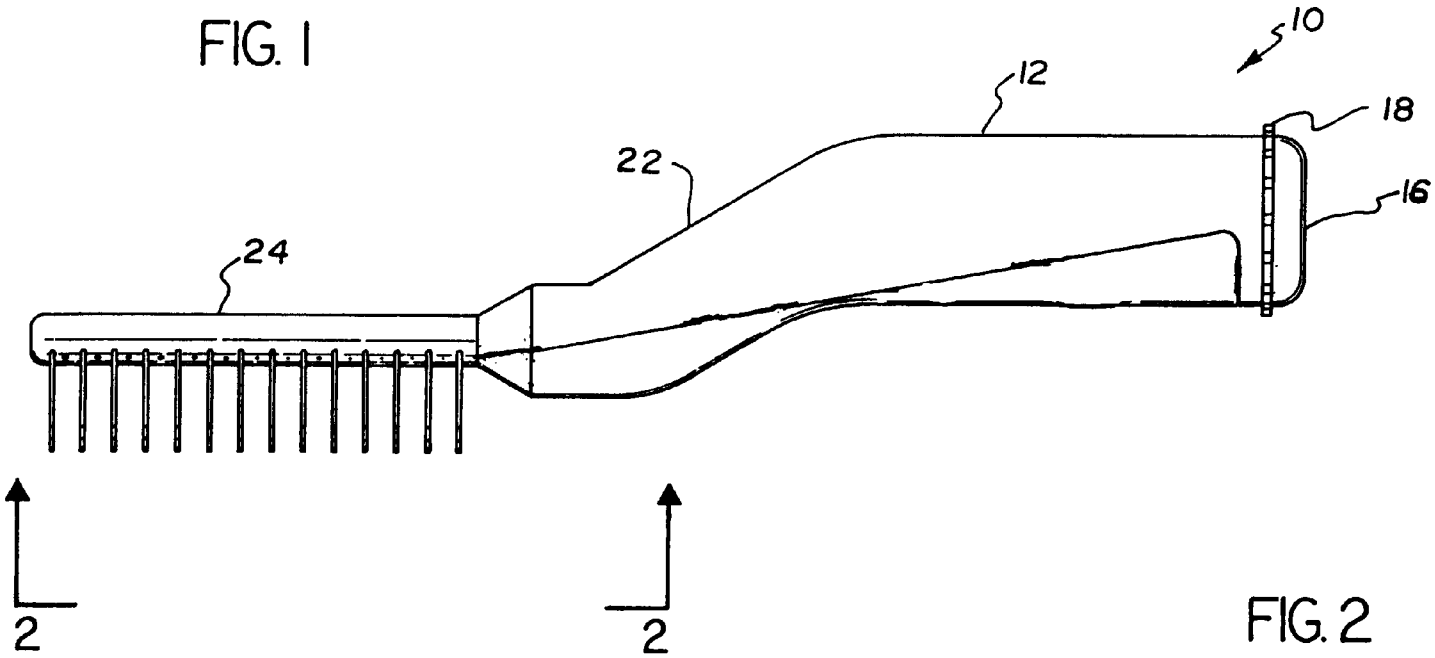
FIG. 1 is a side view of a new squeezable liquid dispensing brush according to the present invention.

With reference now to the drawings, and in particular to FIGS. 1 through 4 thereof, a new squeezable liquid dispensing brush embodying the principles and concepts of the present invention and generally designated by the reference numeral 10 will be described.

The present invention, designated as numeral 10, includes an inboard extent 12 having a hollow generally cylindrical configuration. As shown in the Figures, the inboard extent is preferably equipped with a first length and a first diameter along the entire length thereof. The inboard extent has an open rear with a threaded interior surface 14 for releasably coupling with a dome-shaped cap 16. Such cap has a radially extending flange 18 mounted thereon with a plurality of spaced gripping undulations. A threaded sleeve 20 of the cap is adapted for coupling with the threaded interior surface of the inboard extent. By this structure, a liquid such as hair coloring solution may be situated within the inboard extent.

Figure 4:
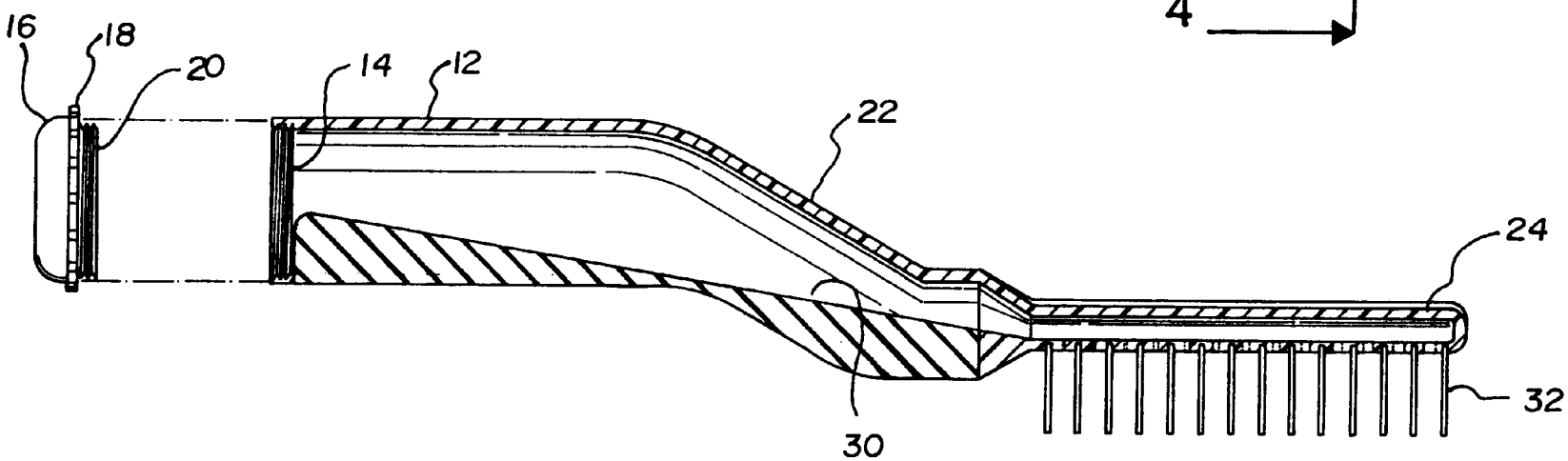
FIG. 4 is a side cross-sectional view of the present invention taken along line 4—4 shown in FIG. 3.

Next provided is an intermediate extent 22 having a hollow generally cylindrical configuration. As shown in FIG. 4, the intermediate extent has the first length and a second diameter less than the first diameter. Further, the intermediate extent includes a rear end integrally coupled to a front end of the inboard extent. The intermediate extent preferably extends from the inboard extent along an axis which resides at an angle of about 30 degrees with respect to that of the inboard extent.

Also included is an outboard extent 24 having a hollow kidney-shaped cross-section and the first length. The outboard extent has a closed front end and a rear end integrally coupled to a front end of the intermediate extent. By such coupling, the outboard extent resides along an axis in parallel relationship with that of the inboard extent.

Figure 2:
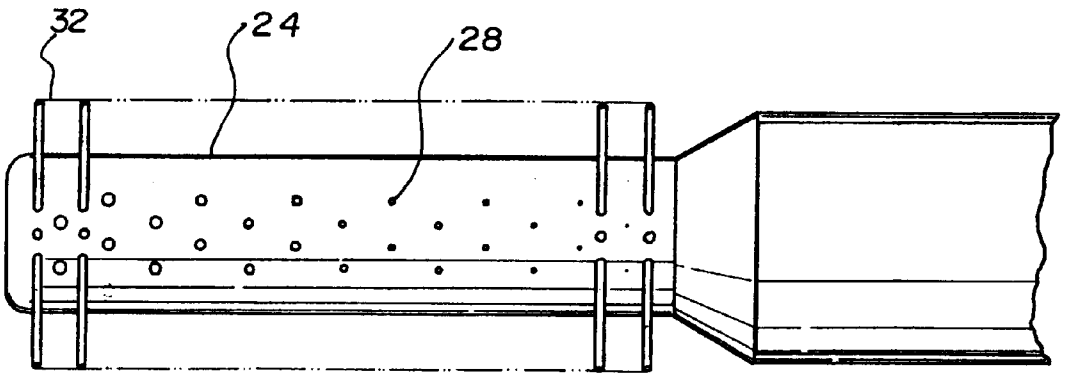
FIG. 2 is a bottom view of the outboard extent of the present invention.
Figure 3:
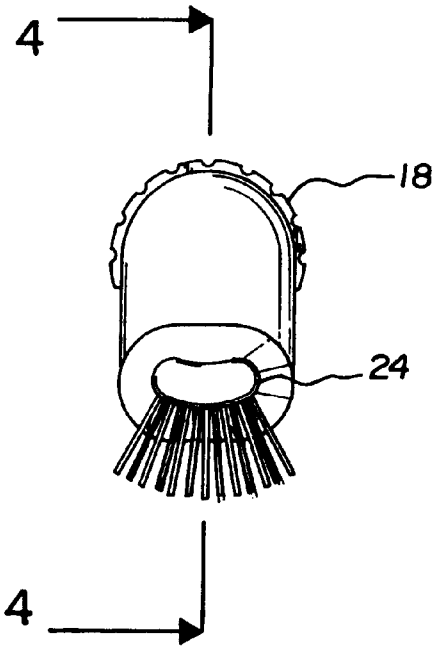
FIG. 3 is an end view of the present invention.

As shown in FIG. 2, the outboard extent has a lower surface with a plurality of bores 28 formed therein in communication between an outer surface of the outboard extent and an interior space of the inboard extent, intermediate extent, and outboard extent. For reasons that will soon become apparent, a size of each of the bores is directly proportional to a distance from the intermediate extent.

With reference again to FIG. 4, it is shown that the inboard extent and intermediate extent have a lower surface with a thickened rigid portion 30 formed in the interior space thereof. As shown in FIG. 4, the thickened rigid portion has a linear tapered configuration. In use, the rigid portion is adapted for maintaining the relative relationship of the inboard and intermediate extents and further directs the flow of liquid to a lower end thereof. This is accomplished while allowing the secretion of the coloring solution from the bores of the outboard extent by the depression of an upper surface of the inboard extent. Due to the sizing of the bores, the liquid hair coloring solution is evenly excreted from the brush. It should be noted that, in the alternative, the thickened rigid portion may be situated on an upper surface of the inboard and intermediate extents such that the lower surface may be depressed.

Finally, a plurality of linear, resilient and solid bristles 32 are provided each having an inboard end mounted on the lower surface of the outboard extent. The bristles extend radially from the outboard extent for combing the coloring solution into hair of a user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A squeezable liquid dispensing brush comprising:

an elongate inboard extent having a hollow interior with a generally cylindrical outer surface configuration of a first length and a first diameter along the entire length thereof, the inboard extent having an open rear with a threaded surface for releasably coupling with a cap, the cap having a radially extending gripping flange mounted thereon with a plurality of spaced undulations and threaded sleeve for coupling with the threaded interior surface of the inboard extent, whereby a coloring solution may be situated within the inboard extent;

an elongate intermediate extent having a hollow interior with a generally cylindrical outer surface configuration and a second diameter less than the first diameter, the intermediate extent having a rear end integrally coupled to a front end of the inboard extent such that the interior of the intermediate extent is in communication with the interior of the inboard extent, the intermediate extent extending from the inboard extent along an axis which is oriented at an angle of about 30 degrees with respect to a longitudinal axis of the inboard extent;

an elongate outboard extent having a hollow interior defined by an interior surface having a kidney-shaped cross-section, the outboard extent having a closed front end and a rear end integrally coupled to a front end of the intermediate extent such that the interior of the outboard extent is in communication with the interiors of the inboard and intermediate extent, the longitudinal axis of the outboard extent being oriented along an axis in parallel relationship with the longitudinal axis of the inboard extent, the outboard extent having a lower surface with a plurality of bores formed therein in communication with the interiors of the inboard extent, intermediate extent, and outboard extent, wherein the bores have a size directly proportional to a distance of the bores from the intermediate extent;

said inboard extent and intermediate extent having a lower surface with a thickened rigid portion formed in the interior, the thickened rigid portion having a planar surface extending straight from approximately a middle location of the open rear of the inboard extent to rear end of the outboard extent for directing coloring solution held in the interiors of the inboard, intermediate, and outboard extents toward the bores of the outboard extent; and a plurality of linear, resilient and solid bristles each having an inboard end mounted on the lower surface of the outboard extent and extending radially therefrom for combing the coloring solution into hair of a user.

2. A liquid dispensing brush comprising:

an inboard extent with a hollow interior;

an intermediate extent coupled to an inboard extent, the inboard extent having a hollow interior; and an outboard extent coupled to the inboard extent with a plurality of bores formed therein in communication with a hollow interior of the inboard extent;

a plurality of bristles each having an inboard end mounted on the outboard extent and extending therefrom for combing a coloring solution into hair of a user;

wherein a contoured exterior surface for comfortable hand gripping is formed by the exteriors of the inboard, intermediate, and outboard extents, the elongate inboard extent having a generally cylindrical outer surface configuration, the elongate intermediate extent having a generally cylindrical outer surface configuration extending from the inboard extent along an axis oriented at an angle of about 30 degrees with respect to a longitudinal axis of the inboard extent, and the elongate outboard extent having an outer surface with an oval-shaped cross-section with the longitudinal axis of the outboard extent being oriented parallel to the longitudinal axis of the inboard extent;

wherein said inboard extent and intermediate extent have a lower surface with a thickened rigid portion formed in the interior, the thickened rigid portion having a planar surface extending straight from a rear end of the inboard extent to a rear end of the outboard extent for directing coloring solution held in the interiors of the inboard, intermediate, and outboard extents toward the bores of the outboard extent.

3. A liquid dispensing brush as set forth in claim 2 wherein said rigid portion maintains a form of the brush while allowing the squeezing of a deformable portion thereof for dispensing liquid from the bores.

4. A liquid dispensing brush as set forth in claim 2 wherein the bores are larger toward a closed end of the outboard extent.

5. A liquid dispensing brush as set forth in claim 2 wherein the rear end of the inboard extent has a cap removably coupled thereto for allowing the insertion of liquid therein.

* * * * *